US008022686B2

(12) United States Patent
Lu et al.

(10) Patent No.: US 8,022,686 B2
(45) Date of Patent: Sep. 20, 2011

(54) REFERENCE CIRCUIT WITH REDUCED CURRENT STARTUP

(75) Inventors: Wei Lu, Singapore (SG); Benjamin L. Amey, Allen, TX (US); Teuta K. Williams, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 287 days.

(21) Appl. No.: 12/436,344

(22) Filed: May 6, 2009

(65) Prior Publication Data

US 2010/0283448 A1 Nov. 11, 2010

(51) Int. Cl.
*G05F 3/16* (2006.01)
*G05F 1/46* (2006.01)

(52) U.S. Cl. ..... 323/315; 323/901

(58) Field of Classification Search ..... 323/311, 323/313, 315, 316, 273, 901
See application file for complete search history.

(56) References Cited

U.S. PATENT DOCUMENTS 5,481,179 A * 1/1996 Keeth ..... 323/315
6,222,399 B1 4/2001 Imbornone et al.
7,323,856 B2 1/2008 Rabeyrin et al.

OTHER PUBLICATIONS

"Low Power Startup Circuits for Voltage and Current Reference with Zero Steady State Current," Proceedings of the 2003 International Symposium on Low Power Electronics and Design, pp. 184-188, Aug. 2003 (Qadeer Ahmed Khan, Sanjay Kumar Wadhwa and Kulbhushan Misri).

* cited by examiner

*Primary Examiner* — Gary L Laxton
(74) *Attorney, Agent, or Firm* — John J. Patti; Wade J. Brady, III; Frederick J. Telecky, Jr.

(57) ABSTRACT

An apparatus is provided. The apparatus comprises a reference circuit and a startup circuit. The reference circuit is adapted to provide a startup current, while the startup circuit receives the startup current and outputs an output voltage. The startup circuit includes a current mirror, a first NMOS transistor, a second NMOS transistor, diodes, and a third NMOS transistor, and a control circuit. The first and second NMOS transistors are coupled to the current mirror at their sources and are coupled to one another and to the reference circuit at their gates. The diodes are coupled between the gate of the second NMOS transistor and the source of the second NMOS transistor, and the third NMOS transistor is coupled to the source of the second NMOS transistor at its gate (which also provides the output voltage at its source). The control circuit is then coupled to the drains of the first and second NMOS transistors.

20 Claims, 1 Drawing Sheet

REFERENCE CIRCUIT WITH REDUCED CURRENT STARTUP

TECHNICAL FIELD

The invention relates generally to reference circuits and, more particularly, to high voltage reference circuits.

BACKGROUND

Reference circuits are commonly used in many devices. Generally, bandgap circuits are used in combination with startup circuits. These startup circuits, especially with high voltage applications (generally between 6V and 40V) like automotive applications, can consume great deal of power. Some examples of conventional circuits are as follows: U.S. Pat. No. 6,222,399; U.S. Pat. No. 7,286,002; U.S. Pat. No. 7,323,856; and Khan et al., "Low Power Startup Circuits for Voltage and Current Reference With Zero Steady State Current," *Proceedings of the* 2003 *International Symposium on Low Power Electronics and Design*, pp. 184-188, August 2003 ("Khan").

One configuration disclosed in Khan and U.S. Pat. No. 7,323,856 employs a capacitor in the startup branch. Essentially, the capacitor (as well as internal resistances) are employed due to their resistor-capacitor (RC) delay or "time constant," which provides a peak current to start the circuit. A problem with this system is that if the supply ramp is about the same order as the time constant then circuit may not startup. Thus, this configuration does not possess the desired characteristics.

SUMMARY

A preferred embodiment of the present invention, accordingly, provides an apparatus. The apparatus comprises a reference circuit that is adapted to provide a startup current; a startup circuit that receives the startup current and outputs an output voltage, wherein the startup circuit includes: a current mirror; a first transistor having a first passive electrode, a second passive electrode, and a control electrode, wherein the first passive electrode of the first transistor is coupled to the current mirror, and wherein the control electrode of the first transistor is coupled to the reference circuit; a second transistor having a first passive electrode, a second passive electrode, and a control electrode, wherein the first passive electrode of the second transistor is coupled to the current mirror, and wherein the control electrode of the second transistor is coupled to the reference circuit and to the control electrode of the first transistor; a plurality of diodes coupled between the control electrode of the second transistor and the first passive electrode of the second transistor; a third transistor having a first passive electrode, a second passive electrode, and a control electrode, wherein the control electrode of the third transistor is coupled to the first passive electrode of the second transistor, and wherein the output voltage is provided from the second passive electrode of the third transistor; and a control circuit that is coupled to the second passive electrodes of the first and second transistors.

In accordance with a preferred embodiment of the present invention, the plurality of diodes further comprises three forward-bias diodes coupled in series.

In accordance with a preferred embodiment of the present invention, the three forward bias diodes are zener diodes.

In accordance with a preferred embodiment of the present invention, the reference circuit further comprises a resistor; and a reverse-bias zener diode coupled to the resistor, wherein the zener diode has a breakdown voltage of about 6 volts, and wherein the cathode of the zener diode is coupled to the control electrodes of the first and second transistors.

In accordance with a preferred embodiment of the present invention, the first and second transistors are NMOS transistors.

In accordance with a preferred embodiment of the present invention, the control circuit further comprises a voltage divider that is coupled to the second passive electrode of the third transistor; a first NPN transistor that is coupled to the second passive electrode of the first transistor at its collector and that is coupled to the voltage divider at its base; a second NPN transistor that is coupled to the second passive electrode of the second transistor at its collector and that is coupled to the voltage divider at its base; a first resistor that is coupled between the emitters of the first and second NPN transistors; and a second resistor that is coupled to the emitter of the second NPN transistor.

In accordance with a preferred embodiment of the present invention, an apparatus is provided. The apparatus comprises a reference circuit that is adapted to provide a startup current; a startup circuit that receives the startup current and outputs an output voltage, wherein the startup circuit includes: a current mirror; a first NMOS transistor that is coupled to the current mirror at its source and that is coupled to the reference circuit at its gate; a second NMOS transistor that is coupled to the current mirror at its drain and that is coupled to the gate of the first NMOS transistor at its gate; a plurality of diodes coupled between the gate of the second NMOS transistor and the drain of the second NMOS transistor; a third NMOS transistor that is coupled to the drain of the second NMOS transistor at its gate and that provides the output voltage at its source; and a control circuit that is coupled to the sources of the first and second NMOS transistors.

In accordance with a preferred embodiment of the present invention, the reference circuit further comprises a resistor; and a reverse-bias zener diode coupled to the resistor, wherein the zener diode has a breakdown voltage of about 6 volts, and wherein the cathode of the zener diode is coupled to the gates of the first and second NMOS transistors.

In accordance with a preferred embodiment of the present invention, the control circuit further comprises a voltage divider that is coupled to the drain of the third NMOS transistor; a first NPN transistor that is coupled to the source of the first NMOS transistor at its collector and that is coupled to the voltage divider at its base; a second NPN transistor that is coupled to the source of the second NMOS transistor at its collector and that is coupled to the voltage divider at its base; a first resistor that is coupled between the emitters of the first and second NPN transistors; and a second resistor that is coupled to the emitter of the second NPN transistor.

In accordance with a preferred embodiment of the present invention, the first NPN is about eight times larger than the second NPN transistor.

In accordance with a preferred embodiment of the present invention, an apparatus is provided. The apparatus comprises a first voltage rail; a second voltage rail; a reference circuit that is coupled between the first and second voltage rails and that is adapted to provide a startup current; a startup circuit that receives the startup current and outputs an output voltage, wherein the startup circuit includes: a first PMOS transistor that is diode-connected and that is coupled at its source to the first voltage rail; a second PMOS transistor that is coupled to the first voltage rail at its source and that is coupled to the gate of the first PMOS transistor at its gate; a first NMOS transistor that is coupled to the drain of the first PMOS transistor at its drain and that is coupled to the reference circuit at its gate; a second NMOS transistor that is coupled to the drain of the second PMOS transistor at its drain and that is coupled to the gate of the first NMOS transistor at its gate; a plurality of diodes coupled between the gate of the second NMOS transistor and the drain of the second NMOS transistor; a third NMOS transistor that is coupled to the drain of the second NMOS transistor at its gate, that is coupled to the first voltage rail at its drain, and that provides the output voltage at its source; a voltage divider that is coupled to the drain of the third NMOS transistor; a first NPN transistor that is coupled to the source of the first NMOS transistor at its collector and that is coupled to the voltage divider at its base; a second NPN transistor that is coupled to the source of the second NMOS transistor at its collector and that is coupled to the voltage divider at its base; a first resistor that is coupled between the emitters of the first and second NPN transistors; and a second resistor that is coupled between the emitter of the second NPN transistor and the second voltage rail.

In accordance with a preferred embodiment of the present invention, the voltage divider further comprises a third resistor that is coupled to the source of the third NMOS transistor; and a fourth resistor that is coupled between the third resistor and the second voltage rail, wherein the bases of the first and second NPN transistors are coupled to the node between the third and fourth transistors.

In accordance with a preferred embodiment of the present invention, the third resistor is about 5MΩ and the fourth resistor is about 2MΩ.

In accordance with a preferred embodiment of the present invention, the first resistor is about 96 kΩ and the second resistor is about 480 kΩ.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
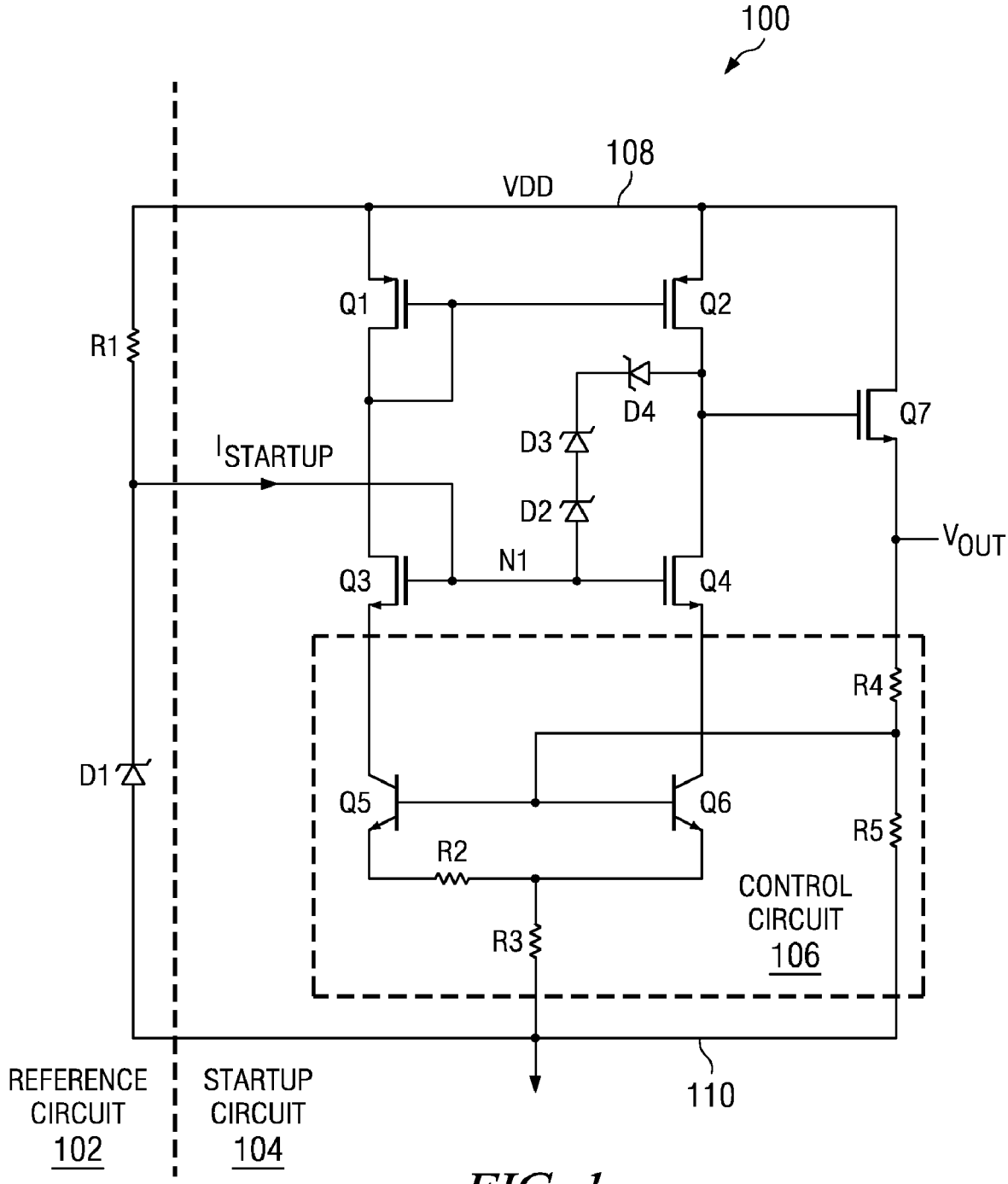
FIG. 1 is a circuit in accordance with a preferred embodiment of the present invention.

Refer now to the drawings wherein depicted elements are, for the sake of clarity, not necessarily shown to scale and wherein like or similar elements are designated by the same reference numeral through the several views.

Referring to FIG. 1 of the drawings, the reference numeral 100 generally designates a circuit in accordance with a preferred embodiment of the present invention. The circuit generally comprises a reference circuit 102 and a startup circuit 104.

The reference circuit 102 generally operates to provide a startup current $I_{STARTUP}$ to the startup circuit 104. As shown, the reference circuit 102 is generally comprised of a resistor R1 (which preferably has a value of about 7MΩ) and a reverse-bias zener diode D1 (which preferably has a breakdown value of about 6V) that are coupled in series with one another between voltage rails 108 and 110. Preferably, voltage rail 108 has a voltage VDD between 6V and 40V (which generally comports with automotive applications), and voltage rail 110 is ground. Alternatively, reference circuit 102 can be a variety of other types of circuits, including, but not limited to, bandgap circuits.

The startup circuit 104 is generally comprised of a current mirror, transistors Q3, Q4, and Q7, diodes D2 through D4, and control circuit 106. The current mirror is generally comprised of transistors Q1 and Q2 (which are preferably PMOS transistors) that are coupled to voltage rail 108. The passive electrodes or sources of each of transistors Q3 and Q4 (which are preferably NMOS transistors) are coupled to the current mirror, and the control electrodes or gates of transistors Q3 and Q4 are coupled to one another and to the reference circuit 102. Diodes D2 through D4 (which are preferably zener diodes) are forward-bias and coupled in series between the control electrode or gate of transistor Q4 and passive electrode of drain of transistor Q4. Transistor Q7 (which is preferably an NMOS transistor) is coupled to the voltage rail 108 at its drain or passive electrode, is coupled to the passive electrode or source of transistor Q4 at its gate or control electrode, and provides an output voltage $V_{OUT}$ at its source or passive electrode. Control circuit 106 can also be coupled to the passive electrodes or sources of transistors Q3 and Q4 and the passive electrode or source of transistor Q7.

The control circuit 106 is generally comprised of bipolar transistors Q5 and Q6 and resistors R2 through R5. Transistor Q5 (which is preferably an NPN transistor and which is about 8 times larger than transistor Q6) is coupled to the passive electrode or source of transistor Q3, while transistor Q6 (which is preferably an NPN transistor) is coupled to the passive electrode or source of transistor Q3. Additionally, the bases of transistors Q5 and Q6 are coupled to one another. Coupled between the emitters of transistors Q5 and Q6 is resistor R6 (which preferably has a value of about 96 kΩ), and resistor R3 (which preferably has a value of about 480 kΩ) is coupled between the emitter of transistor Q6 and voltage rail 110. Resistors R4 and R5 (which preferably have values of about 5MΩ and about 7MΩ, respectively) are coupled in series with one another between the passive electrode or source of transistor Q7 and voltage rail 110 to form a voltage divider. The bases of transistors Q5 and Q6 are also coupled to the node between the resistors R4 and R5.

Generally, when no startup current $I_{STARTUP}$ is provided (the voltage VDD is low), the startup circuit 104 outputs zero volts as the output voltage $V_{OUT}$. However, when a startup current $I_{STARTUP}$ is provided to the startup circuit 104, a path (provided by diodes D2 through D4) is provided to transistor Q7 so as to charge transistor Q7. Additionally, the startup current $I_{STARTUP}$ turns on transistors Q3 and Q4, allowing the bias voltages from transistors Q3 and Q4 to protect transistors Q5 and Q6. This allows the circuit 100 to startup as the voltage VDD increases. Essentially, when the voltage VDD on voltage rail 108 increases the voltage at node N1 will pull up the voltage on the gate or control electrode of transistor Q7. After startup is complete, the voltage on gate or control electrode of transistor Q7 is high enough so that virtually no current flows back through the diodes D2 through D4.

By having this general configuration, several advantages can be noted. First, large resistors (typically on the order of several megaohms) in the startup circuit 104 to restrict static current can be eliminated. Additionally, high voltage capacitors (which generally occupy a large areas) can be eliminated; this also effectively eliminates the use of a resistor-capacitor (RC) delay or time constant to provide a peak current for startup. Also, for situations where large load increases are present, the path (provided by diodes D2 through D4) provides extra current to maintain the desired output voltage $V_{OUT}$ (and output current), thus, providing an improved transient load response.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a reference circuit that is adapted to provide a startup current;

a startup circuit that receives the startup current and outputs an output voltage, wherein the startup circuit includes:

a current mirror;

a first transistor having a first passive electrode, a second passive electrode, and a control electrode, wherein the first passive electrode of the first transistor is coupled to the current mirror, and wherein the control electrode of the first transistor is coupled to the reference circuit;

a second transistor having a first passive electrode, a second passive electrode, and a control electrode, wherein the first passive electrode of the second transistor is coupled to the current mirror, and wherein the control electrode of the second transistor is coupled to the reference circuit and to the control electrode of the first transistor;

a plurality of diodes coupled between the control electrode of the second transistor and the first passive electrode of the second transistor;

a third transistor having a first passive electrode, a second passive electrode, and a control electrode, wherein the control electrode of the third transistor is coupled to the first passive electrode of the second transistor, and wherein the output voltage is provided from the second passive electrode of the third transistor; and a control circuit that is coupled to the second passive electrodes of the first and second transistors.

2. The apparatus of claim 1, wherein the plurality of diodes further comprises three forward-bias diodes coupled in series.

3. The apparatus of claim 2, wherein the three forward bias diodes are zener diodes.

4. The apparatus of claim 1, wherein the reference circuit further comprises:

a resistor; and a reverse-bias zener diode coupled to the resistor, wherein the zener diode has a breakdown voltage of about 6 volts, and wherein the cathode of the zener diode is coupled to the control electrodes of the first and second transistors.

5. The apparatus of claim 1, wherein the first and second transistors are NMOS transistors.

6. The apparatus of claim 1, wherein the control circuit further comprises:

a voltage divider that is coupled to the second passive electrode of the third transistor;

a first NPN transistor that is coupled to the second passive electrode of the first transistor at its collector and that is coupled to the voltage divider at its base;

a second NPN transistor that is coupled to the second passive electrode of the second transistor at its collector and that is coupled to the voltage divider at its base;

a first resistor that is coupled between the emitters of the first and second NPN transistors; and a second resistor that is coupled to the emitter of the second NPN transistor.

7. An apparatus comprising:

a reference circuit that is adapted to provide a startup current;

a startup circuit that receives the startup current and outputs an output voltage, wherein the startup circuit includes:

a current mirror;

a first NMOS transistor that is coupled to the current mirror at its source and that is coupled to the reference circuit at its gate;

a second NMOS transistor that is coupled to the current mirror at its drain and that is coupled to the gate of the first NMOS transistor at its gate;

a plurality of diodes coupled between the gate of the second NMOS transistor and the drain of the second NMOS transistor;

a third NMOS transistor that is coupled to the drain of the second NMOS transistor at its gate and that provides the output voltage at its source; and a control circuit that is coupled to the sources of the first and second NMOS transistors.

8. The apparatus of claim 7, wherein the plurality of diodes further comprises three forward-bias diodes coupled in series.

9. The apparatus of claim 8, wherein the three forward bias diodes are zener diodes.

10. The apparatus of claim 7, wherein the reference circuit further comprises:

a resistor; and a reverse-bias zener diode coupled to the resistor, wherein the zener diode has a breakdown voltage of about 6 volts, and wherein the cathode of the zener diode is coupled to the gates of the first and second NMOS transistors.

11. The apparatus of claim 7, wherein the control circuit further comprises:

a voltage divider that is coupled to the drain of the third NMOS transistor;

a first NPN transistor that is coupled to the source of the first NMOS transistor at its collector and that is coupled to the voltage divider at its base;

a second NPN transistor that is coupled to the source of the second NMOS transistor at its collector and that is coupled to the voltage divider at its base;

a first resistor that is coupled between the emitters of the first and second NPN transistors; and a second resistor that is coupled to the emitter of the second NPN transistor.

12. The apparatus of claim 11, wherein the first NPN is about eight times larger than the second NPN transistor.

13. An apparatus comprising:

a first voltage rail;

a second voltage rail;

a reference circuit that is coupled between the first and second voltage rails and that is adapted to provide a startup current;

a startup circuit that receives the startup current and outputs an output voltage, wherein the startup circuit includes:

a first PMOS transistor that is diode-connected and that is coupled at its source to the first voltage rail;

a second PMOS transistor that is coupled to the first voltage rail at its source and that is coupled to the gate of the first PMOS transistor at its gate;

a first NMOS transistor that is coupled to the drain of the first PMOS transistor at its drain and that is coupled to the reference circuit at its gate;

a second NMOS transistor that is coupled to the drain of the second PMOS transistor at its drain and that is coupled to the gate of the first NMOS transistor at its gate;

a plurality of diodes coupled between the gate of the second NMOS transistor and the drain of the second NMOS transistor;

a third NMOS transistor that is coupled to the drain of the second NMOS transistor at its gate, that is coupled to the first voltage rail at its drain, and that provides the output voltage at its source;

a voltage divider that is coupled to the drain of the third NMOS transistor;

a first NPN transistor that is coupled to the source of the first NMOS transistor at its collector and that is coupled to the voltage divider at its base;

a second NPN transistor that is coupled to the source of the second NMOS transistor at its collector and that is coupled to the voltage divider at its base;

a first resistor that is coupled between the emitters of the first and second NPN transistors; and a second resistor that is coupled between the emitter of the second NPN transistor and the second voltage rail.

14. The apparatus of claim 13, wherein the plurality of diodes further comprises three forward-bias diodes coupled in series.

15. The apparatus of claim 14, wherein the three forward bias diodes are zener diodes.

16. The apparatus of claim 13, wherein the reference circuit further comprises:

a resistor; and a reverse-bias zener diode coupled to the resistor, wherein the zener diode has a breakdown voltage of about 6 volts, and wherein the cathode of the zener diode is coupled to the gates of the first and second NMOS transistors.

17. The apparatus of claim 12, wherein the first NPN is about eight times larger than the second NPN transistor.

18. The apparatus of claim 13, wherein the voltage divider further comprises:

a third resistor that is coupled to the source of the third NMOS transistor; and a fourth resistor that is coupled between the third resistor and the second voltage rail, wherein the bases of the first and second NPN transistors are coupled to the node between the third and fourth transistors.

19. The apparatus of claim 18, wherein the third resistor is about 5MΩ and the fourth resistor is about 2MΩ.

20. The apparatus of claim 13, wherein the first resistor is about 96 kΩ and the second resistor is about 480 kΩ.

* * * * *